US010461478B2

(12) United States Patent
Sakaizawa et al.

(10) Patent No.: US 10,461,478 B2
(45) Date of Patent: Oct. 29, 2019

(54) CONNECTOR HAVING SHELL AND CONNECTOR DEVICE

(71) Applicant: HIROSE ELECTRIC CO., LTD., Tokyo (JP)

(72) Inventors: Tadashi Sakaizawa, Tokyo (JP); Kenichi Naganuma, Tokyo (JP)

(73) Assignee: HIROSE ELECTRIC CO., LTD., Tokyo (JP)

( * ) Notice: Subject to any disclaimer, the term of this patent is extended or adjusted under 35 U.S.C. 154(b) by 0 days.

(21) Appl. No.: 16/075,881

(22) PCT Filed: Feb. 27, 2017

(86) PCT No.: PCT/JP2017/007561

§ 371 (c)(1),
(2) Date: Aug. 6, 2018

(87) PCT Pub. No.: WO2017/146259

PCT Pub. Date: Aug. 31, 2017

(65) Prior Publication Data

US 2019/0058289 A1 Feb. 21, 2019

(30) Foreign Application Priority Data

Feb. 26, 2016 (JP) ..... 2016-035635

(51) Int. Cl.
*H01R 13/658* (2011.01)
*H01R 13/6582* (2011.01)
(Continued)

(52) U.S. Cl.
CPC ..... *H01R 13/6582* (2013.01); *H01R 13/6273* (2013.01); *H01R 13/639* (2013.01)

(58) Field of Classification Search
CPC . H01R 13/6582; H01R 13/6273; H01R 13/69
(Continued)

(56) References Cited

U.S. PATENT DOCUMENTS 7,628,638 B2 * 12/2009 Wu ..... H01R 9/032 439/358
7,845,965 B2 * 12/2010 Ko ..... H01R 4/023 439/352
(Continued)

FOREIGN PATENT DOCUMENTS

CN 201498784 U 6/2010
JP 2000252018 A 9/2000
(Continued)

OTHER PUBLICATIONS

International Search Report dated May 23, 2017 filed in PCT/JP2017/007561.
(Continued)

*Primary Examiner* — Alexander Gilman
(74) *Attorney, Agent, or Firm* — Rankin, Hill & Clark LLP

(57) ABSTRACT

Provided is a connector configured so that tensile strength when an attempt is made to forcibly detach the connector from a partner connector can be enhanced. A housing includes a body portion and a fitting target portion extending to the side of fitting to the partner connector. The diameter of a side portion outer peripheral surface of the fitting target portion is, at at least part thereof, smaller than that of the body portion. A conductive shell includes a first shell and a second shell. The first shell includes a cover portion configured to cover at least part of an outer peripheral surface of the housing, an elastic arm having a free end on the side of fitting to the partner connector, and a support portion elastically connecting the cover portion and the elastic arm and configured to support the elastic arm in a cantilever manner. The elastic arm has a lock portion configured to lock fitting to the partner connector, and has a stepped portion corresponding to a stepped surface of the housing provided using a difference in the diameter. The second shell includes
(Continued)

a portion facing the stepped portion at a position closer to the side of fitting to the partner connector than the stepped portion of the elastic arm.

9 Claims, 13 Drawing Sheets

(51) Int. Cl.
*H01R 13/639* (2006.01)
*H01R 13/627* (2006.01)

(58) Field of Classification Search
USPC ..... 439/353
See application file for complete search history.

(56) References Cited

U.S. PATENT DOCUMENTS 8,142,224 B2 * 3/2012 Wu ..... H01R 13/648 439/353
8,556,648 B2 * 10/2013 Wu ..... H01R 13/5213 439/276
9,620,914 B2 * 4/2017 Park ..... H01R 13/56
9,793,662 B2 * 10/2017 Kao ..... H01R 24/60
10,044,147 B2 * 8/2018 Listing ..... H01R 13/533
2006/0270267 A1 * 11/2006 Akutagawa ..... H01R 13/64 439/374
2007/0141891 A1 * 6/2007 Koyama ..... H01R 13/6275 439/358
2008/0090441 A1 * 4/2008 Takeuchi ..... H01R 13/6275 439/344
2008/0090457 A1 * 4/2008 Takeuchi ..... H01R 9/032 439/607.01
2011/0034061 A1 2/2011 Wu

FOREIGN PATENT DOCUMENTS

JP 2002367732 A 12/2002
JP 2008103113 A 5/2008
JP 2008103114 A 5/2008
WO 2005099046 A1 10/2005

OTHER PUBLICATIONS

Chinese Office Action dated Jul. 24, 2019 for the corresponding Chinese Patent Application No. 201780007747.1 and its English machine translation.

* cited by examiner

CONNECTOR HAVING SHELL AND CONNECTOR DEVICE

TECHNICAL FIELD

The present invention relates to a connector including a shell and a connector device.

BACKGROUND ART

JP-A-2002-367732 (Patent Literature 1) describes one example of a connector having a lock mechanism using a shell. The connector of this type has been utilized as an interface of electronic equipment such as a mobile phone, a PDA, or a personal computer. For these types of electronic equipment, high-speed signal operation has been developed day by day. The shell is provided, so that a characteristic impedance can be adjusted and a shield effect against electromagnetic wave noise from the outside can be obtained. Patent Literature 1 further describes that the lock mechanism is provided at the shell to suppress casual cancellation of fitting.

An exploded perspective view of a connector 100 disclosed in Patent Literature 1 is illustrated in FIG. 13. Note that an outer hood is not shown in this figure. The connector 100 mainly includes an insulator 103 and a base shell 101 and a cover shell 102 covering the insulator 103. The base shell 101 is formed from a single metal plate. The base shell 101 includes a flat plate 111 as a ceiling plate, side pieces 112 bent at right angle on lateral sides of the flat plate 111 and arms 113 coupled to the side pieces 112 and supported in a cantilever manner. An engagement piece 113*a* is provided in the vicinity of a tip end of each arm 113, and upon fitting to a partner connector (not shown), such a portion functions as a portion configured to engage with a predetermined portion of the partner connector to lock fitting to the partner connector.

However, this configuration of Patent Literature 1 has a problem that when the connector is forcibly detached from the partner connector after the connector and the partner connector have been fitted to each other, an elastic arm easily deforms, and as a result, the connector is damaged.

CITATION LIST

Patent Literature

PATENT LITERATURE 1: JP-A-2002-367732

SUMMARY OF THE INVENTION

Problems to be Solved by the Invention

The present invention has been made to solve the problems on the above-described typical technique, and is intended to provide a connector configured so that tensile strength when an attempt is made to forcibly detach the connector from a partner connector after the connector and the partner connector have been fitted to each other can be enhanced.

Solution to the Problems

For solving the above-described problems, a connector according to one aspect of the present invention is a connector fittable to a partner connector. The connector includes a housing, a contact attached to the housing, and a conductive shell attached to the housing. The housing includes a body portion and a fitting target portion extending from the body portion to the side of fitting to the partner connector. The diameter of a side portion outer peripheral surface of the fitting target portion is, at at least part thereof, set smaller than the diameter of a side portion outer peripheral surface of the body portion. The conductive shell includes a first shell and a second shell. The first shell includes a cover portion configured to cover at least part of an outer peripheral surface of the housing, an elastic arm having a free end on the side of fitting to the partner connector, and a support portion elastically connecting the cover portion and the elastic arm and configured to support the elastic arm in a cantilever manner. The elastic arm has a lock portion configured to lock fitting between the connector and the partner connector at a position closer to a free end side than the support portion. The elastic arm has a stepped portion corresponding to a stepped surface of the housing provided using a difference in the diameter between the body portion and the fitting target portion. The second shell includes a portion facing the stepped portion at a position closer to the side of fitting to the partner connector than the stepped portion of the elastic arm.

According to the connector of this aspect, the portion facing the stepped portion is provided at at least part of the second shell. When the connector is forcibly detached from the partner connector after the connector and the partner connector have been fitted to each other, part of the elastic arm and at least part of the second shell come into collision with each other in association with deformation of the elastic arm. Thus, the tensile strength can be enhanced through such collision. Moreover, according to the connector of this aspect, the diameter of the fitting target portion is smaller than the diameter of the body portion, and therefore, the connector can be downsized. Further, according to the connector of this aspect, the second shell is provided in addition to the first shell, so that a shelling effect at the body portion of the housing can be enhanced.

In the connector of the above-described aspect, at least part of the free end side of the elastic arm may be provided at a position closer to the fitting target portion than the support portion in a radial direction. With this configuration, the connector can be downsized.

Moreover, in the connector of the above-described aspect, at least part of the free end side of the elastic arm having the lock portion is arranged between the second shell and the housing. With this configuration, at least part of the free end side of the elastic arm can be protected by the second shell to suppress buckling of the elastic arm, and the connector and the partner connector can be more smoothly fitted to each other.

Further, in the connector of the above-described aspect, a recess configured to house at least part of the free end side of the elastic arm is preferably provided at the fitting target portion of the housing. Since the space for housing the elastic arm is provided at the fitting target portion, a clearance between the second shell and the housing can be more reduced.

In addition, in the connector of the above-described aspect, the at least part of the free end side of the elastic arm arranged between the second shell and the housing is preferably constantly biased from a housing side toward a second shell side. Since the elastic arm is biased, fixing force utilizing the elastic arm can be enhanced.

Moreover, in the connector of the above-described aspect, the second shell may have a surface extending in the radial direction, and at the surface, may be able to contact the stepped surface of the housing and/or the first shell. With the contact portion, the position of the second shell can be easily determined.

Further, in the connector of the above-described aspect, the cover portion and the elastic arm preferably have substantially opposing surfaces. According to this aspect, the elastic arm and the cover portion contact each other at the surfaces thereof, so that part of the housing can be covered with double plate surfaces. Thus, the shielding effect can be increased.

In addition, in the connector of the above-described aspect, the conductive shell preferably further includes a third shell configured to cover at least part of the outer peripheral surface of the body portion not covered with the first shell. With the third shell, the shielding effect can be enhanced.

In the connector of the above-described aspect, the first shell may be formed from a single metal plate.

Moreover, in the connector of the above-described aspect, the connector and the partner connector may be grouped as a connector device.

Effect of the Invention

According to the present invention, the tensile strength when an attempt is made to forcibly detach the connector from the partner connector after the connector and the partner connector have been fitted to each other can be enhanced.

DESCRIPTION OF THE EMBODIMENTS

Hereinafter, a connector and a connector device according to one preferred embodiment of the present invention will be described with reference to the drawings.

Figure 1:
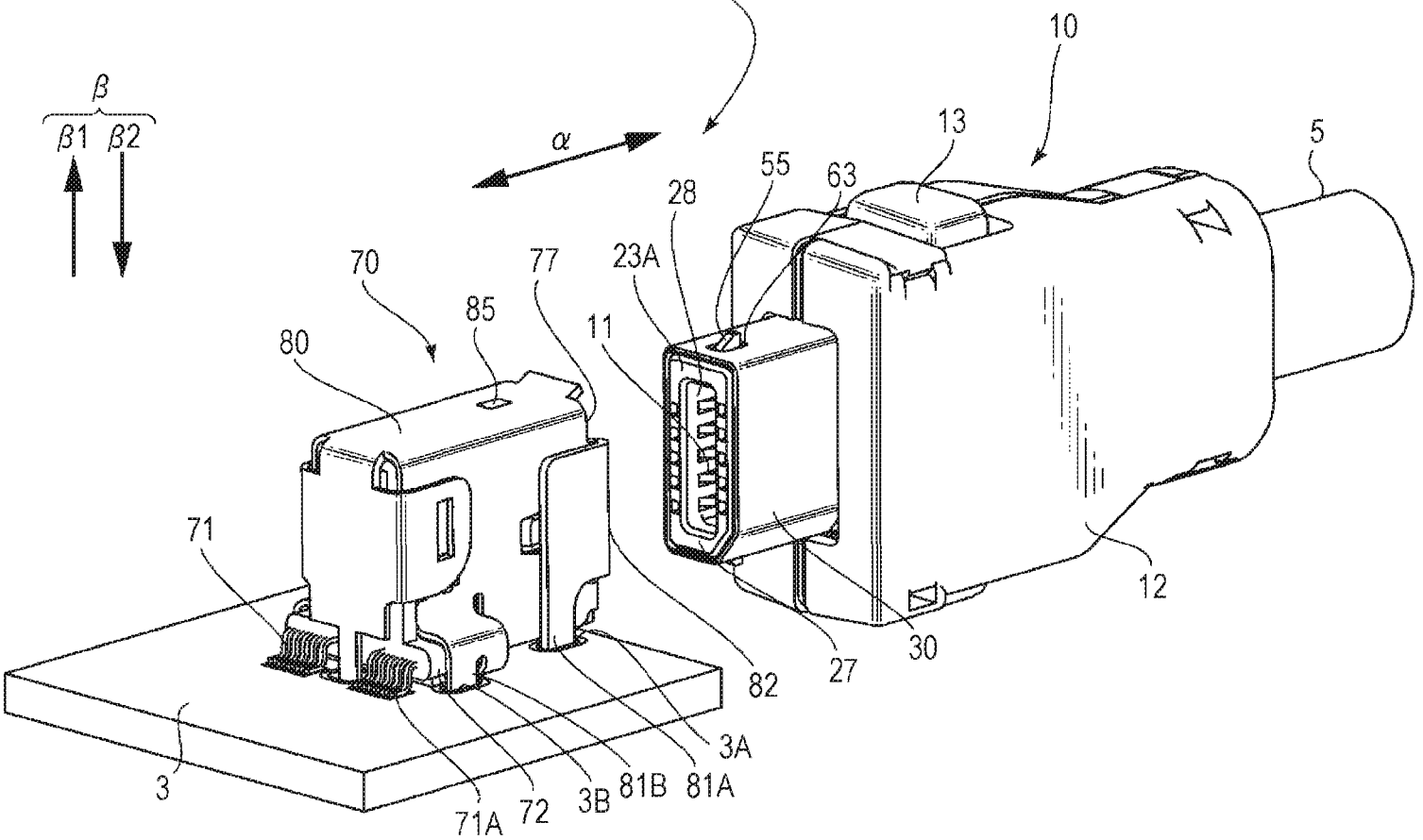
FIG. 1 is a perspective view of a connector device according to one preferred embodiment of the present invention.

FIG. 1 illustrates a perspective view of a connector device 1 according to one preferred embodiment of the present invention. The connector device 1 includes a group of a connector 10 and a partner connector 70 fittable to each other. The connector 10 may be, for example, a cable connector connected to an electric cable 5, and on the other hand, the partner connector 70 may be, for example, a substrate connector connected to a substrate 3. An electric cable connector will be described herein as a preferred example, but needless to say, it is not intended to limit the present invention to the electric cable connector. With a connector structure for which a configuration of the present invention can be employed, the present invention is applicable to various connector devices. For example, the present configuration is applicable to an optical connector. Alternatively, the connector 10 may be a substrate connector, and the partner connector 70 may be a cable connector. Alternatively, both of the connector 10 and the partner connector 70 may be substrate connectors or cable connectors.

The cable connector 10 and the substrate connector 70 can be freely attached/detached in such a manner that the cable connector 10 and the substrate connector 70 are moved close to each other or moved away from each other along the direction of an arrow "α" illustrated in the figure. Using shells, fitting between the cable connector 10 and the substrate connector 70 can be locked. When the cable connector 10 and the substrate connector 70 are fitted to each other, a tapered fitting target portion provided at a shell 30 of the cable connector 10 is inserted into a substantially rectangular fitting hole 77 provided at a front surface of the substrate connector 70, and a lock portion, such as a lock protrusion 55, elastically protruding from each of upper and lower portions of a tip portion of the cable connector 10 is moved in the direction of an arrow "β1" illustrated in the figure by elasticity of the lock protrusion 55 itself on, e.g., an upper side, and then, is fitted in a lock target portion, such as a through-hole 85, provided at a corresponding one of a ceiling portion and a bottom portion of a shell 80 of the substrate connector 70. As a result, fitting between the cable connector 10 and the substrate connector 70 is locked. Such locking can be easily unlocked in such a manner that a button 13 provided at the cable connector 10 is pressed in the direction of an arrow "β2" illustrated in the figure as the opposite direction of "β1" on, e.g., the upper side to displace an elastic arm 50 and the lock protrusion 55 is moved and removed out of the through-hole 85, for example. Note that the lock portions of the substrate connector are good enough to lock predetermined portions of the cable connector 10. Thus, the lock portions are not limited to the through-holes 85, and may be recesses and the like.

The substrate connector 70 mainly has an insulating housing 72, a contact 71 held on the housing 72 with part of the contact 71 being exposed through the housing 72, and the conductive shell 80 configured to cover outer peripheral surfaces of the housing 72.

The fitting hole 77 to which part of the connector 10 is to be fitted is provided at a front surface of the housing 72, and a fitting raised portion (not shown) matching to the shape of a fitting port of the connector 10 is further provided at the fitting hole 77. One end side of the contact 71 is arranged in an exposed state at the fitting raised portion, and on the other hand, the other end side 71A of the contact 71 is soldered onto the substrate 3.

The shell 80 covers substantially all outer peripheral surfaces of exposed surfaces of the housing 72 other than the fitting hole 77. Specifically, at right and left edges of the fitting hole 77, folding-back portions 82 are provided to ensure strength. Lower end portions 81A of the folding-back portions 82 each penetrate through-holes 3A of the substrate 3, and are utilized for determination of the position of the shell 80 and fixing of the shell 80 to the substrate. The shell is fixed to a predetermined position of the substrate, and therefore, is grounded. Similarly, lower end portions 81B of the shell 80 are also utilized for, e.g., fixing to the substrate 3 even on a side apart from the fitting hole 77.

Figure 2:
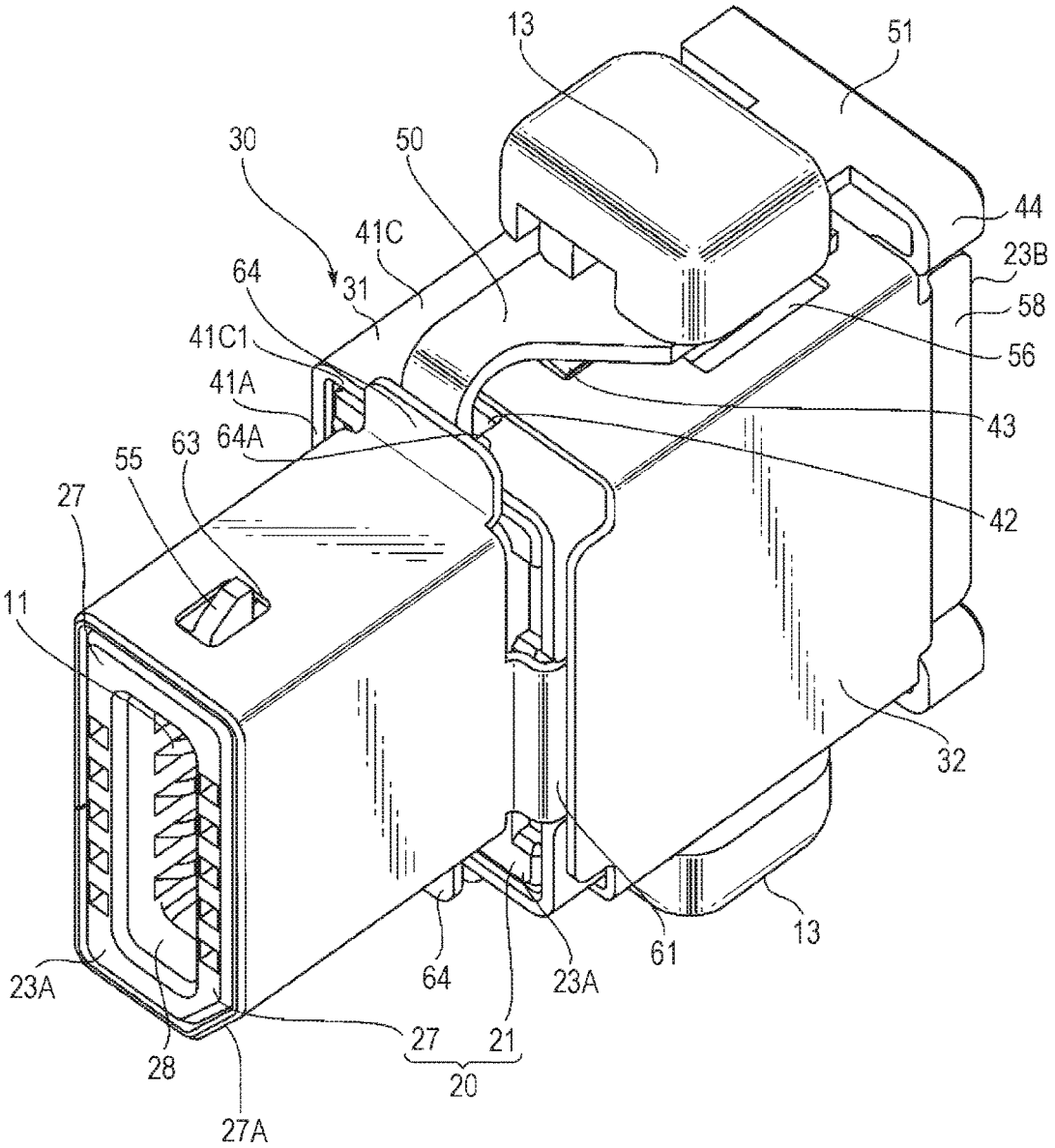
FIG. 2 is a perspective view of a cable connector with a hood being removed from FIG. 1.
Figure 3:
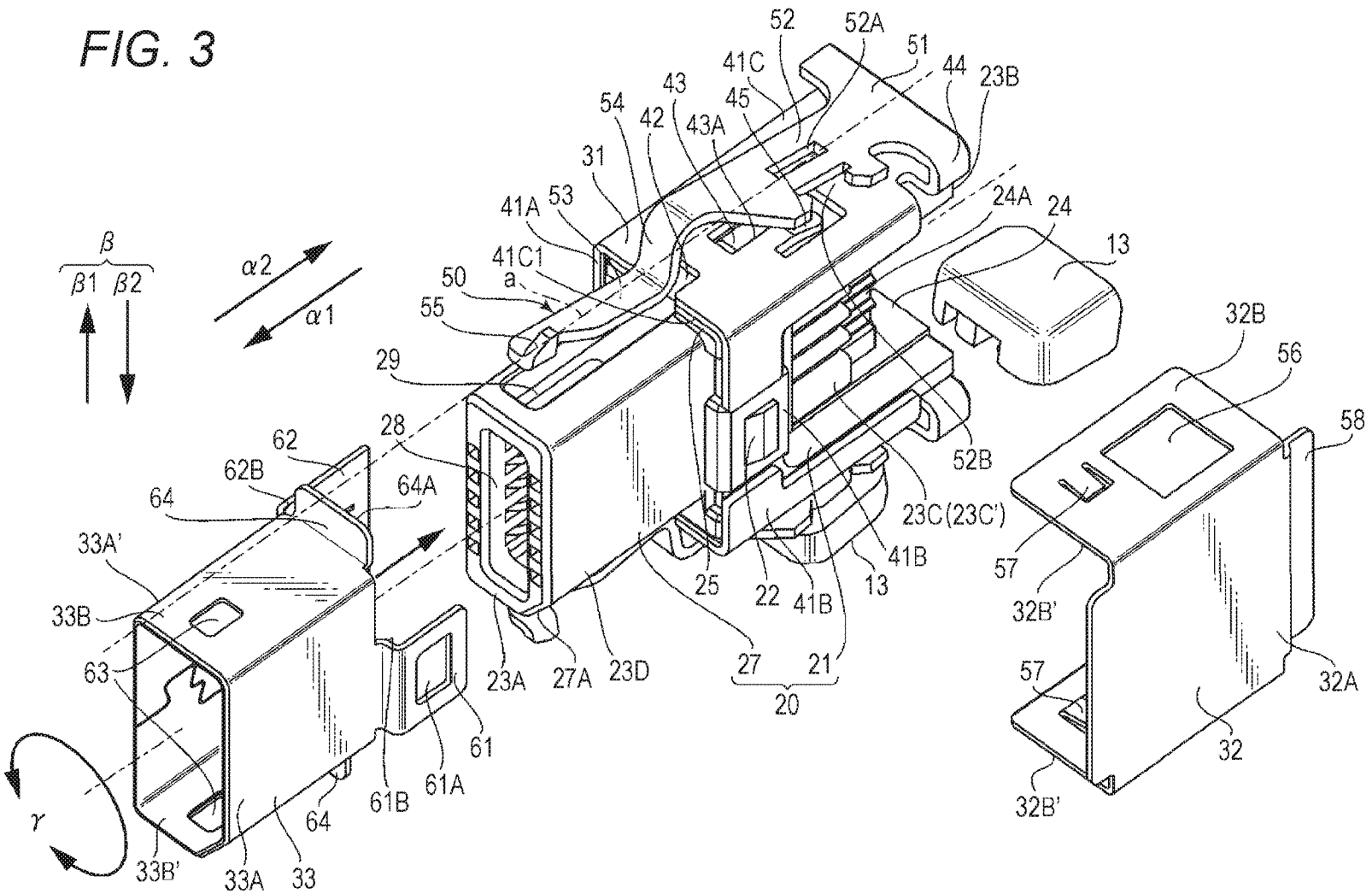
FIG. 3 is an exploded perspective view of the cable connector of FIG. 2.

FIG. 2 is a perspective view of the cable connector 10 with a hood 12 being removed from FIG. 1, and FIG. 3 is an exploded perspective view of the cable connector 10 of FIG. 2. Note that the exploded perspective view of FIG. 3 is not complete, and part of the shell 30, i.e., a later-described body shell 31, is attached to a body portion 21 of a housing 20.

The cable connector 10 mainly has the insulating housing 20, a contact 11 held on the housing 20 with part of the contact 11 being exposed through the housing 20, the conductive shell 30 configured to cover outer peripheral surfaces of the housing 20, and the insulating hood 12 configured to cover outer peripheral surfaces of the shell 30.

A fitting target portion 27 to be inserted into the fitting hole 77 of the substrate connector 70 is provided at a fitting-side front surface of the housing 20, and a fitting recessed portion 28 into which the fitting raised portion provided at the fitting hole 77 of the substrate connector 70 is to be inserted is further provided at the fitting target portion 27. One end side of the contact 11 is arranged in an exposed state at the fitting recessed portion 28, and on the other hand, the other end side of the contact 11 is electrically connected to a corresponding portion of the electric cable 5.

The housing 20 includes the body portion 21 and the fitting target portion 27 extending from the body portion 21 to the side of fitting to the substrate connector 70. Lateral sections of the body portion 21 and the fitting target portion 27 are both in a substantially rectangular shape. A space for fixing cables is provided inside the body portion 21, and for arraying the cables, a cable fixing member 24 provided with groove-shaped cable fixing portions 24A each corresponding to core wires of the cables is placed in this space. Moreover, one corner portion forming a side surface of the fitting target portion 27 is a flat surface 27A for suppressing erroneous fitting.

The diameter of side portion outer peripheral surfaces 23D of the fitting target portion 27 along a circumferential direction (the direction of an arrow "γ" illustrated in the figure) of the housing 20 is set slightly smaller than the diameter of side portion outer peripheral surfaces 23C of the body portion 21. The fitting target portion 27 has a smaller diameter than that of the body portion 21 as described above, so that a space for the process of connecting the contact 11 and the cables in the body portion 21 can be ensured and a portion corresponding to the fitting target portion 27 can be relatively downsized. Thus, size reduction in the connector device is realized. Note that in the fitting target portion 27 of the present embodiment, all of the side portion outer peripheral surfaces 23D are set smaller than 23C of the body portion 21, but all surfaces are not necessarily set smaller. At least some of the side portion outer peripheral surfaces 23D of the fitting target portion 27, such as only opposing surfaces in an upper-to-lower direction (the direction of an arrow "β" illustrated in the figure) of FIG. 3 or only opposing surfaces in a right-to-left direction perpendicular to the upper-to-lower direction, may be set smaller than the side portion outer peripheral surfaces 23C of the body portion 21. Using such a diameter difference, a stepped surface 25 is formed, for example, along a radial direction (e.g., a direction along "β") of the housing 20 between the body portion 21 and the fitting target portion 27. Note that the stepped surface 25 is not necessarily provided along the radial direction, and may be inclined from a small diameter side to a large diameter side as the stepped surface 25 extends from the side of fitting to the substrate connector 70 to the opposite side of the fitting side.

The shell 30 includes the body shell 31, a plate-shaped shell 32, and a tubular shell 33. The plate-shaped shell 32 is not necessarily required, and can be omitted. Note that these shells are provided, so that substantially all outer peripheral surfaces of exposed surfaces of the housing 20 other than a front face side 23A and a back face side 23B can be covered. The body shell 31 mainly covers the outer peripheral surfaces, specifically the side portion outer peripheral surfaces 23C, of the body portion 21 of the housing 20. The plate-shaped shell 32 mainly covers the outer peripheral surfaces of the body portion 21 not covered with the body shell 31. The tubular shell 33 mainly covers the outer peripheral surfaces, specifically the side portion outer peripheral surfaces 23D, of the fitting target portion 27 of the housing 20. Moreover, the body shell 31 is mainly attached to the housing 20, the plate-shaped shell 32 is mainly attached to the body shell 31, and the tubular shell 33 is mainly attached to both of the body portion 21 and the plate-shaped shell 32.

Figure 4:
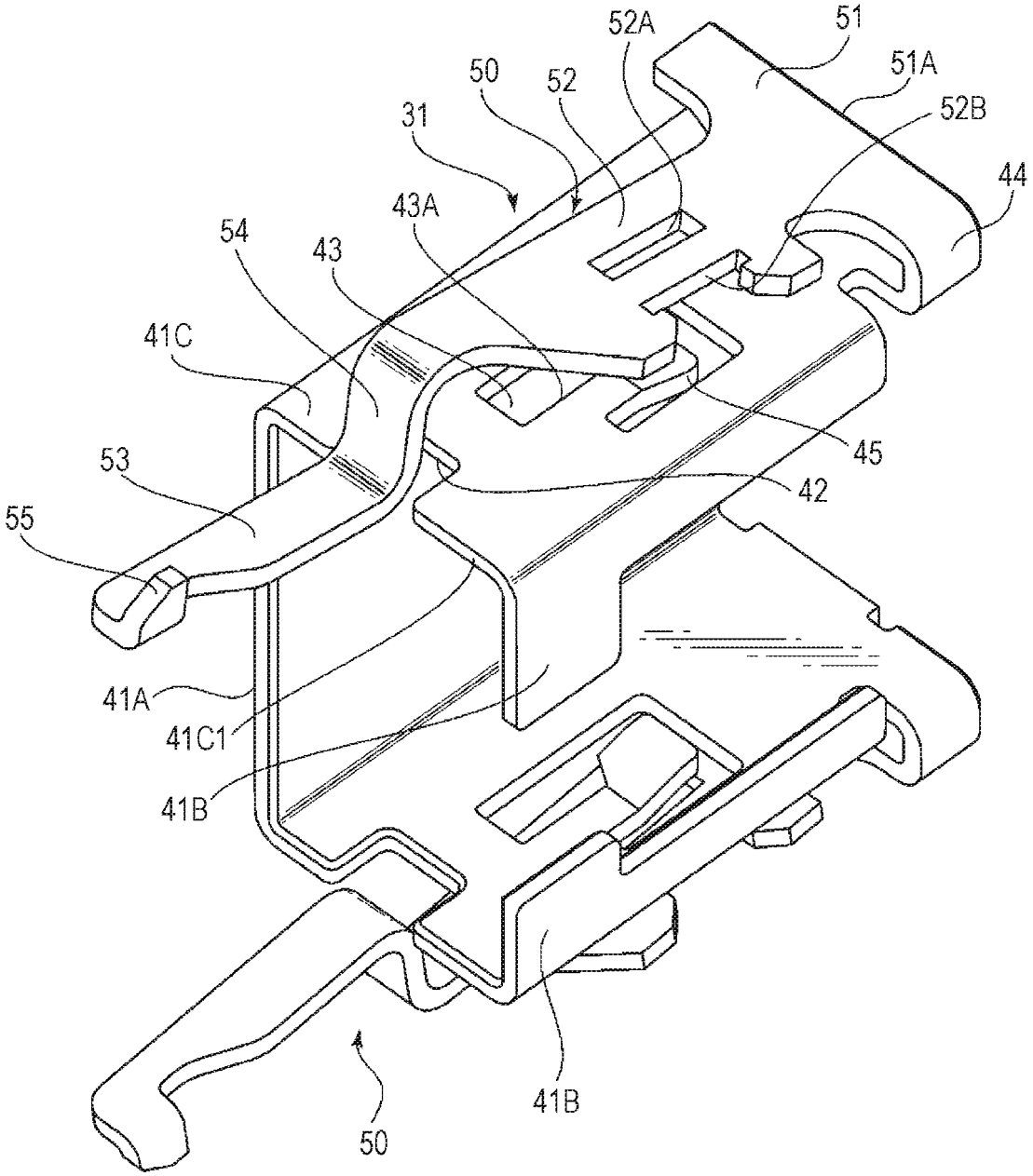
FIG. 4 is a front perspective view of a body shell.
Figure 5:
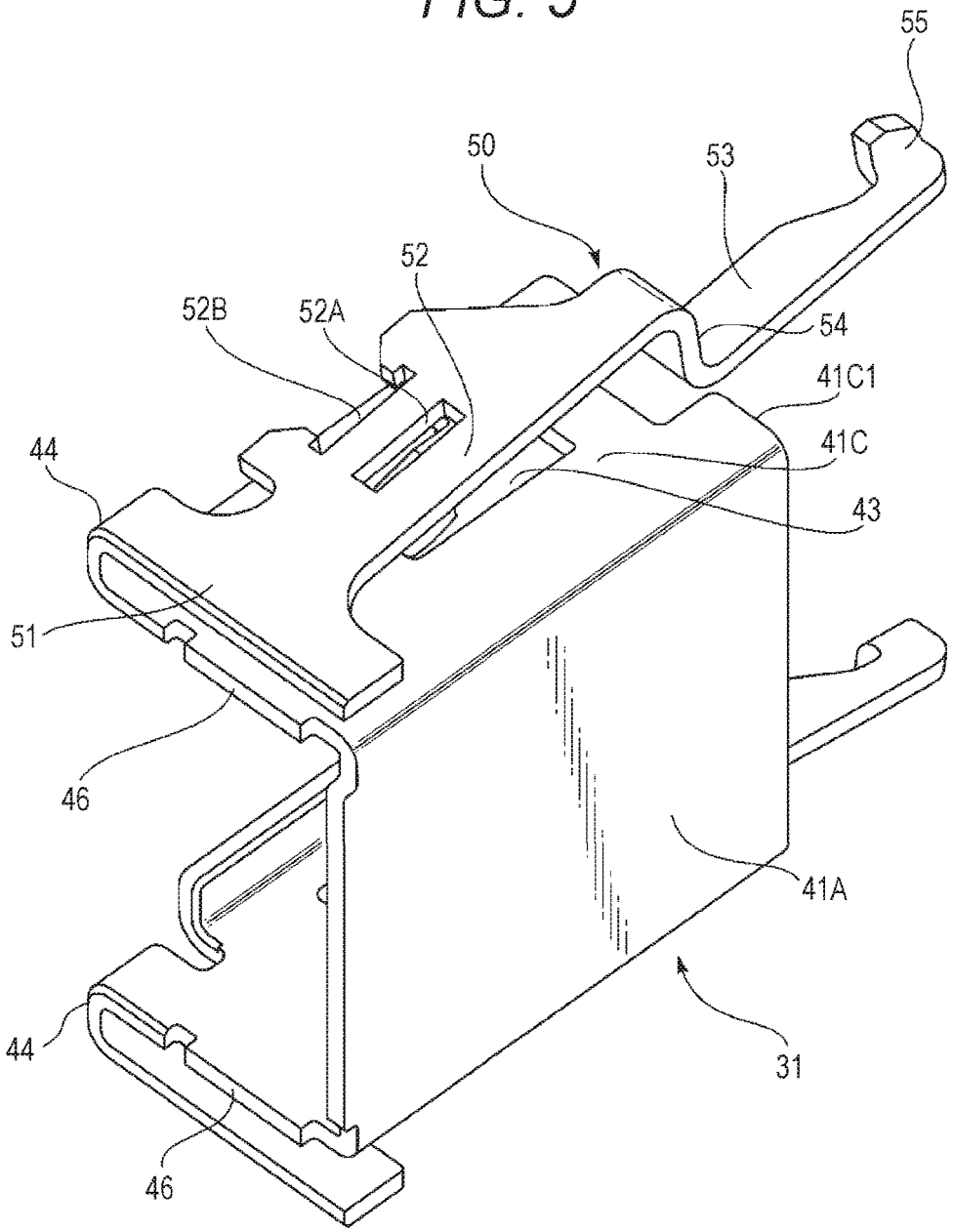
FIG. 5 is a back perspective view of the body shell.
Figure 6:
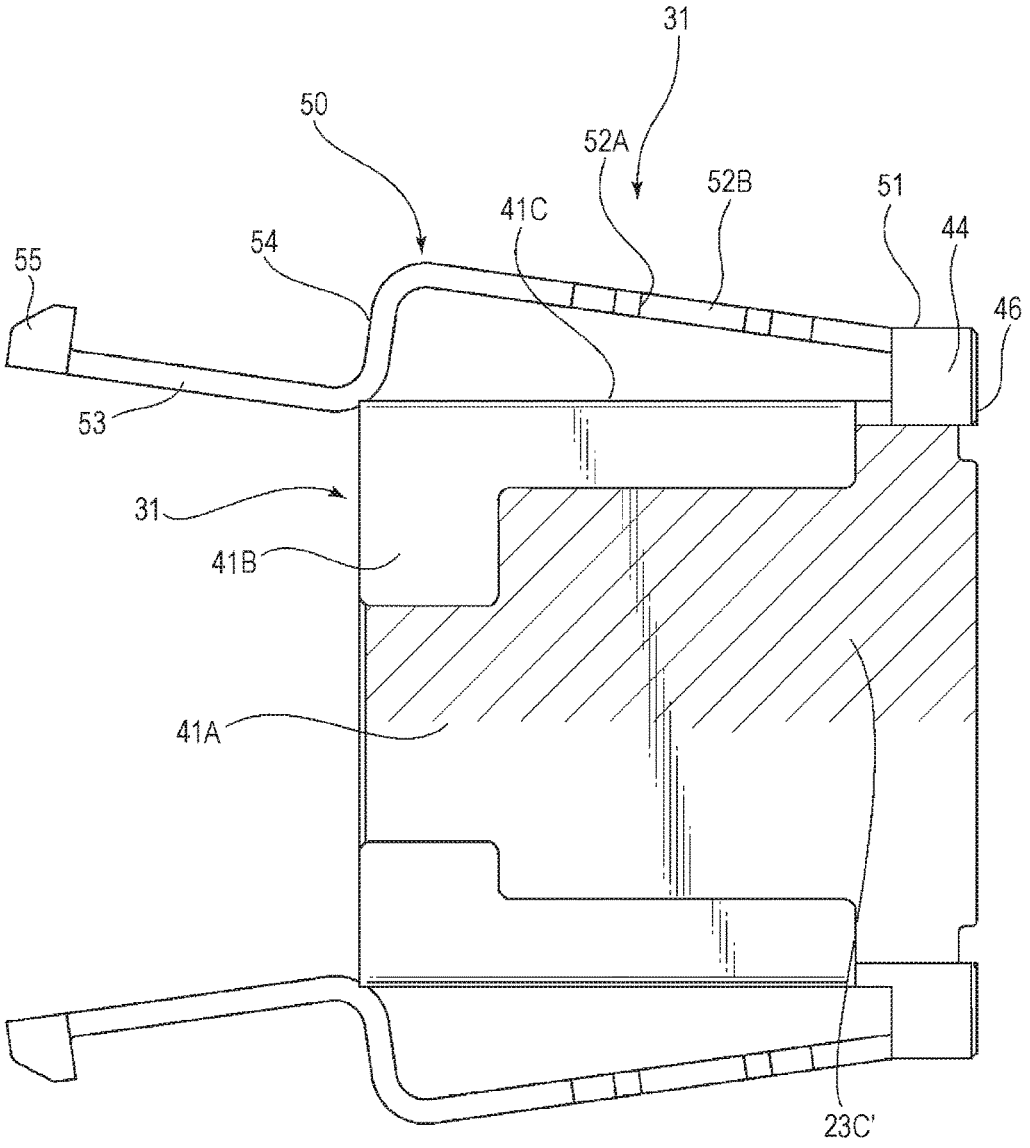
FIG. 6 is a side view of the body shell.

FIGS. 4 to 6 illustrate perspective views as individual item views of the body shell 31. FIG. 4 is a front perspective view of the body shell 31, FIG. 5 is a back perspective view of the body shell 31, and FIG. 6 is a side view of the body shell 31, The body shell 31 has, as a whole, a substantially C-shaped section. For example, the body shell 31 includes the elastic arms 50 having free ends on the side of fitting to the substrate connector 70, a longitudinal plate portion 41A configured to cover at least some of the side portion outer peripheral surfaces 23C of the body portion 21, such as one longitudinal surface of the housing 20, a longitudinal piece 41B configured to cover part of the other longitudinal surface, and lateral plate portions 41C configured to cover upper and lower lateral surfaces. The body shell 31 is formed in such a manner that a single metal plate is punched and bent. Thus, all of the above-described portions included in the body shell 31 are continuous to each other. Fixing to the housing 20 is performed in such a manner that attachment pieces 45 provided at the lateral plate portions 41C are retained at predetermined positions of the housing 20, for example.

The elastic arm 50 and the lateral plate portion 41C are elastically connected together through a support portion 44 formed as a folding-back portion in a substantially U-shape as viewed in section, for example. By connection through the support portion 44, the elastic arm 50 is supported on the lateral plate portion 41C in a cantilever manner. Needless to say, the support portion 44 is not limited to the U-shape, and may be in a substantially inverted C-shape, a substantially V-shape, or a shape with continuous multiple substantially V-shapes as viewed in section, for example. A cutout 42 is provided at a front edge of the lateral plate portion 41C to avoid collision with the elastic arm 50.

A position provided with the support portion 44 at the elastic arm 50 may be, for example, a lateral side or a back side (the opposite side of the side of fitting to the substrate connector 70) of the elastic arm 50. Note that in the case of connection on the lateral side, the elastic arm 50 can be supported on a side closer to the free end 55 of the elastic arm 50 as compared to the case of connection on the lateral side of the elastic arm 50. As a result, elastic force of the elastic arm 50 can be enhanced. Moreover, in the case of connection on the lateral side, the length of the support portion 44 on the lateral side, i.e., the length of a portion substantially along a longitudinal direction of the elastic arm 50, is adjusted, so that the elastic force can be easily and relatively freely adjusted. For example, the length of the support portion 44 on the lateral side is set short, so that the elastic force can be weakened, and is set long, so that the elastic force can be increased. In this case, a length on the side of connection to the elastic arm 50 and a length on the side of connection to the lateral plate portion 41C may be set to the same length as in the illustrated embodiment, or may be different from each other, for example. Alternatively, the elastic force may be weakened in such a manner that a hole is punched in the support portion 44, for example. In this case, the support portion 44 has a greater width than that in the case of providing the support portion 44 on the back side, and therefore, such a hole can be relatively easily provided. Further, in the case of connection at the back of the elastic arm 50, a long plate material for the elastic arm is, for a flat metal plate before processing of the elastic arm 50 such as bending, necessary on the back side of the support portion 44 between the lateral plate portion 41C and the elastic arm 50. However, connection on the lateral side eliminates the necessity of such a plate material, leading to effective use of a resource. Further, in this case, the plate material unnecessary for forming the elastic arm is utilized, so that a holding portion configured to hold a cable can be, without the back of the lateral plate portion 41C forming a cut surface 46, provided in a state in which the holding portion is coupled to the back of the lateral plate portion 41C, for example. Alternatively, such a plate material is utilized, so that a shell material configured to cover a back end portion of the housing can be formed.

The elastic arm 50 is supported in a state in which the elastic arm 50 exhibits elasticity to displace relative to the lateral plate portion 41C in the substantially radial direction about the support portion 44. The phrasing of the "substantially radial direction" is used because the elastic arm 50 is connected to the support portion 44 on the lateral side, and therefore, it is assumed that the elastic force acts in a direction shifted to one side to a certain extent. In the case of using the V-shaped support portion 44, inclination becomes greater. The elastic arm 50 is, through the support portion 44, held apart from the lateral plate portion 41C in the radial direction. In the case, the elastic arm 50 and the lateral plate portion 41C have substantially opposing surfaces. With this configuration, part of the housing can be covered with double plate suffices, and therefore, a shielding effect can be enhanced. The phrasing of "substantially opposing" is used because of reasons similar to those described above. That is, the elastic arm 50 is connected to the support portion 44 on the lateral side, and therefore, does not always face the lateral plate portion 41C from right in front thereof. For obtaining advantageous effects of the present configuration, the elastic arm 50 and the lateral plate portion 41C are good enough to overlap with each other on the plane thereof.

The elastic arm 50 extends from the body portion 21 to the fitting target portion 27 of the housing 20. The elastic arm includes a relatively wide support-portion-side portion 52 extending from a base portion 51 extending laterally and continuously from the support portion 44 toward the substrate connector 70, and a relatively narrow free-end-side portion 53. The former wide portion 52 is mainly positioned on the side of the body portion 21 of the housing 20, and the latter narrow portion 53 is mainly positioned on the side of the fitting target portion 27 of the housing 20.

Figure 7:
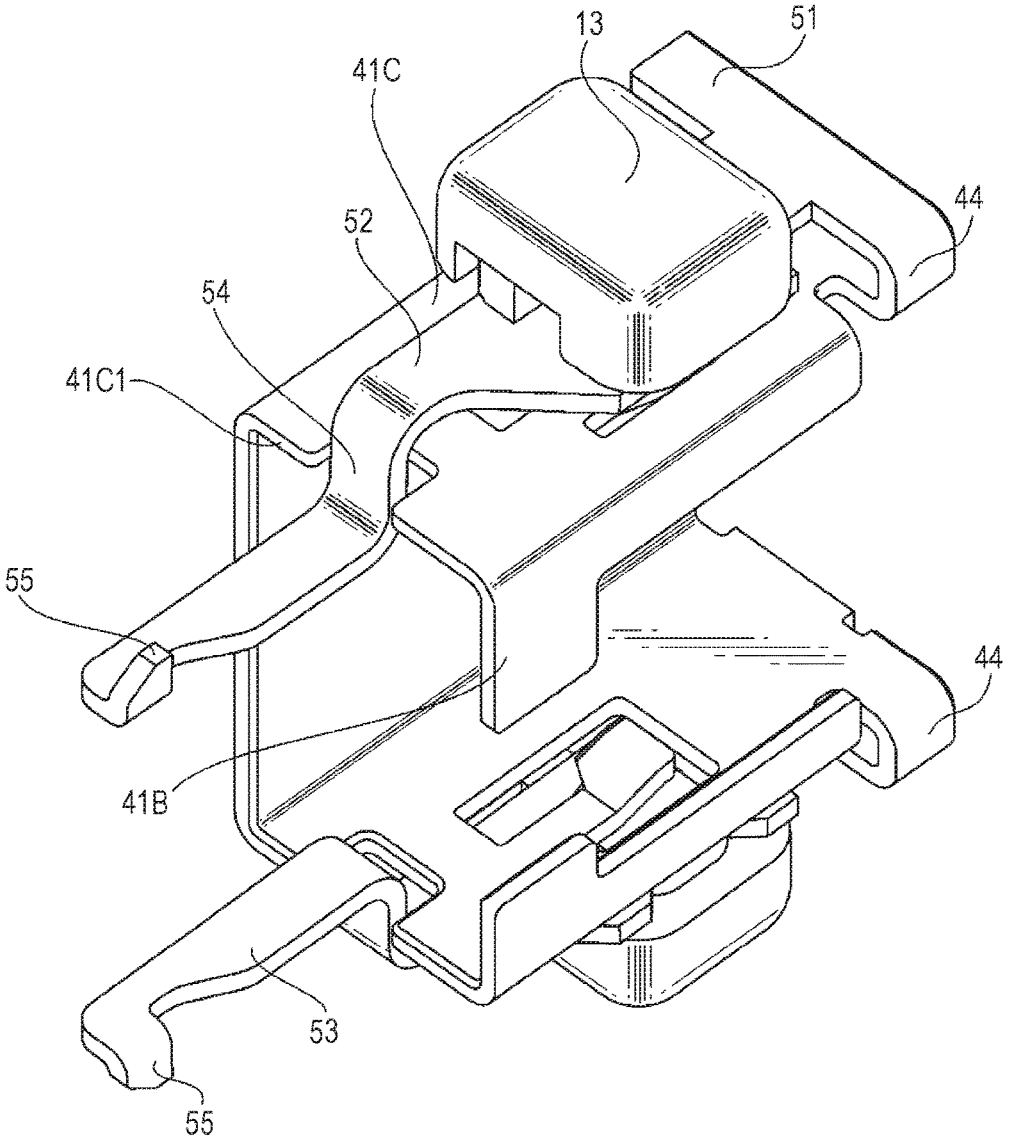
FIG. 7 is a perspective view corresponding to FIG. 4, the view illustrating a state in which a button is attached.
Figure 8:
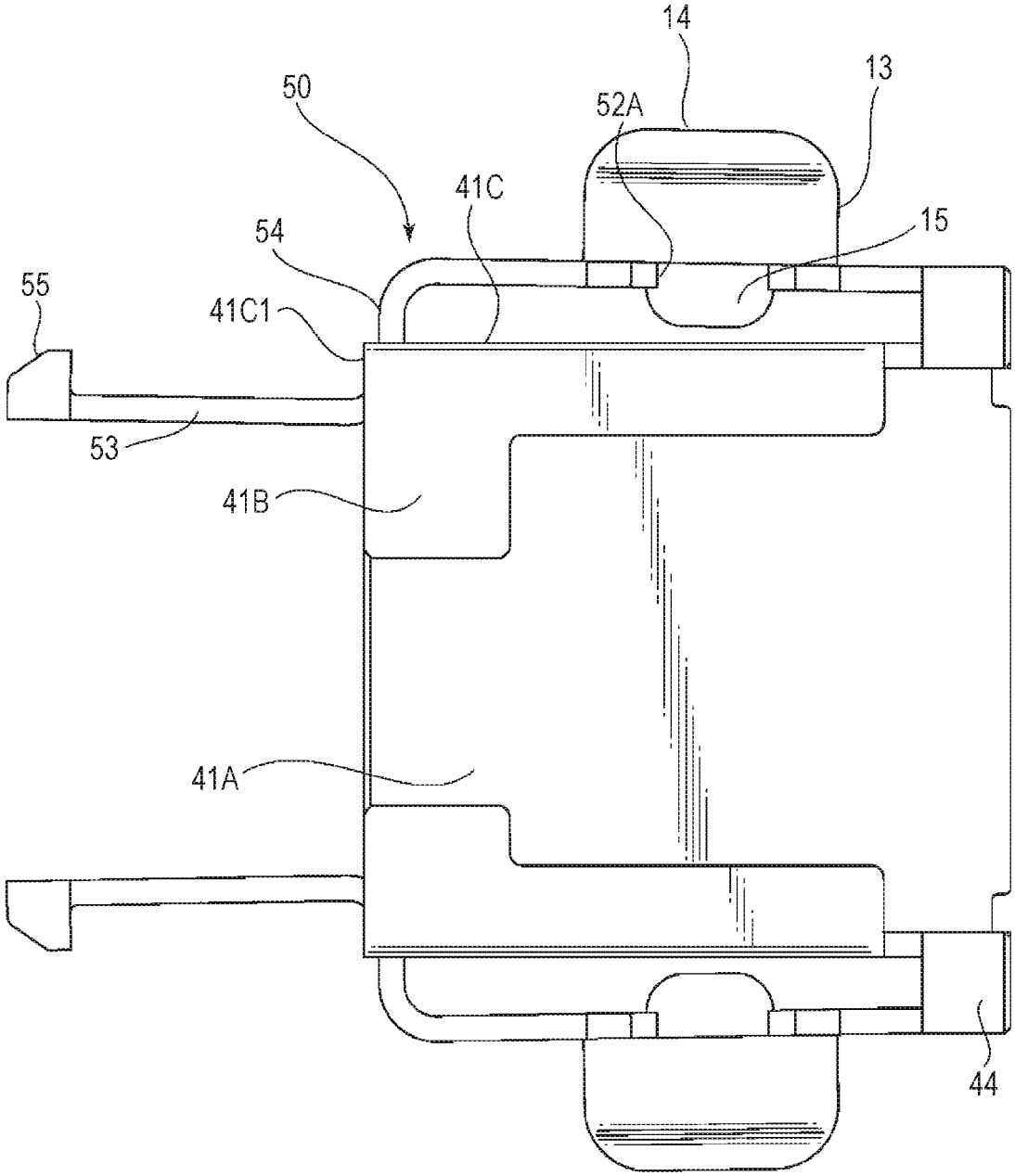
FIG. 8 is a perspective view corresponding to FIG. 6, the view illustrating the state in which the button is attached.

At the narrow portion 53, a stepped portion 54 is formed corresponding to the stepped surface 25 formed between the body portion 21 and the fitting target portion 27. The stepped portion 54 is substantially along the stepped surface 25. As in the phrasing of "substantially along," it is not required that the stepped portion 54 is precisely "along" the stepped surface 25, and may be "along" the stepped surface 25 in a state in which conditions required in the embodiment are satisfied. For example, when the stepped surface 25 is inclined, the stepped portion 54 may be inclined accordingly. The stepped portion 54 is preferably inclined. Moreover, at the narrow portion 53, the lock portion, such as the lock protrusion 55, configured to lock fitting between the cable connector 10 and the substrate connector 70 upon such fitting is provided to stand substantially perpendicularly at a position closer to a free end side of the elastic arm 50 than the support portion 44. At least part of the free end side of the elastic arm 50 provided with the lock protrusion 55 is provided closer to the fitting target portion 27 than the support portion 44 in the radial direction (e.g., "β"), and it is configured such that the device is easily downsized. The lock protrusion 55 is movable in the direction of "β" by elastic action of the support portion 44. For facilitating the operation of pressing the elastic arm 50, i.e., operation in the "β2" direction, a hole 52A and a cutout 52B for attaching a pressing member for unlocking operation, such as the button 13, are provided at the wide portion 52. As illustrated in FIGS. 7 and 8 each corresponding to FIGS. 4 and 6, the cutout 52B is utilized to determine the position of the button 13 between the support portion 44 and the stepped portion 54, and an attachment portion 15 of the button 13 is fitted in the hole 52A, so that the button 13 can be fixed at a predetermined position of the elastic arm 50.

As in the body shell 31, the plate-shaped shell 32 is formed in such a manner that a single metal plate is punched and bent. For example, the plate-shaped shell 32 includes a longitudinal plate portion 32A and lateral plate portions 32B each provided on the upper and lower. The plate-shaped shell 32 has, as a whole, a substantially inverted C-shaped section.

The lateral plate portions 32B are mainly used for fixing the plate-shaped shell 32 to the body shell 31. The lateral plate portions 32B are attached to sandwich the lateral plate portions 41C of the body shell 31 in the upper-to-lower direction. As a result, the plate-shaped shell 32 and the body shell 31 overlap with each other at these lateral plate portions. When the plate-shaped shell 32 is attached to the body shell 31, tongue-shaped attachment pieces 57 provided at the plate-shaped shell 32 are each retained at edges 43A of attachment holes 43 provided at the body shell 31. In this manner, the plate-shaped shell 32 is fixed to the body shell 31. Note that a clearance hole 56 is provided in the vicinity of the center of each lateral plate portion 32B of the plate-shaped shell 32, and therefore, operation of the button 13 attached to the body shell 31 is not interfered even when the plate-shaped shell 32 and the body shell 31 overlap with each other. Moreover, for suppressing collision with the elastic arm 50 provided at the body shell 31, an edge 32B' of each lateral plate portion 32B of the plate-shaped shell 32 is formed slightly recessed toward the center side with respect to the longitudinal plate portion 32A.

For example, the longitudinal plate portion 32A covers the side portion outer peripheral surface 23C of the outer peripheral surfaces of the body portion 21 not covered with the body shell 31, specifically the side portion outer peripheral surface 23C positioned close to the support portion 44 with respect to a substantial center line "a" of the elastic arm 50 along the direction "α" of fitting to the substrate connector 70. In the case of providing the elastic arm 50, part of the body shell 31 is used for the elastic arm 50, and for this reason, the area of the housing 20 which can be covered with the body shell 31 is reduced by the elastic arm 50. For example, the longitudinal plate portion 32A of the plate-shaped shell 32 can cover at least some of the side portion outer peripheral surfaces which finally become coverable with the body shell 31 by folding back of the support portion 44, such as a region of a shaded portion 23C' of FIG. 6. This can enhance the shielding effect.

Figure 9:
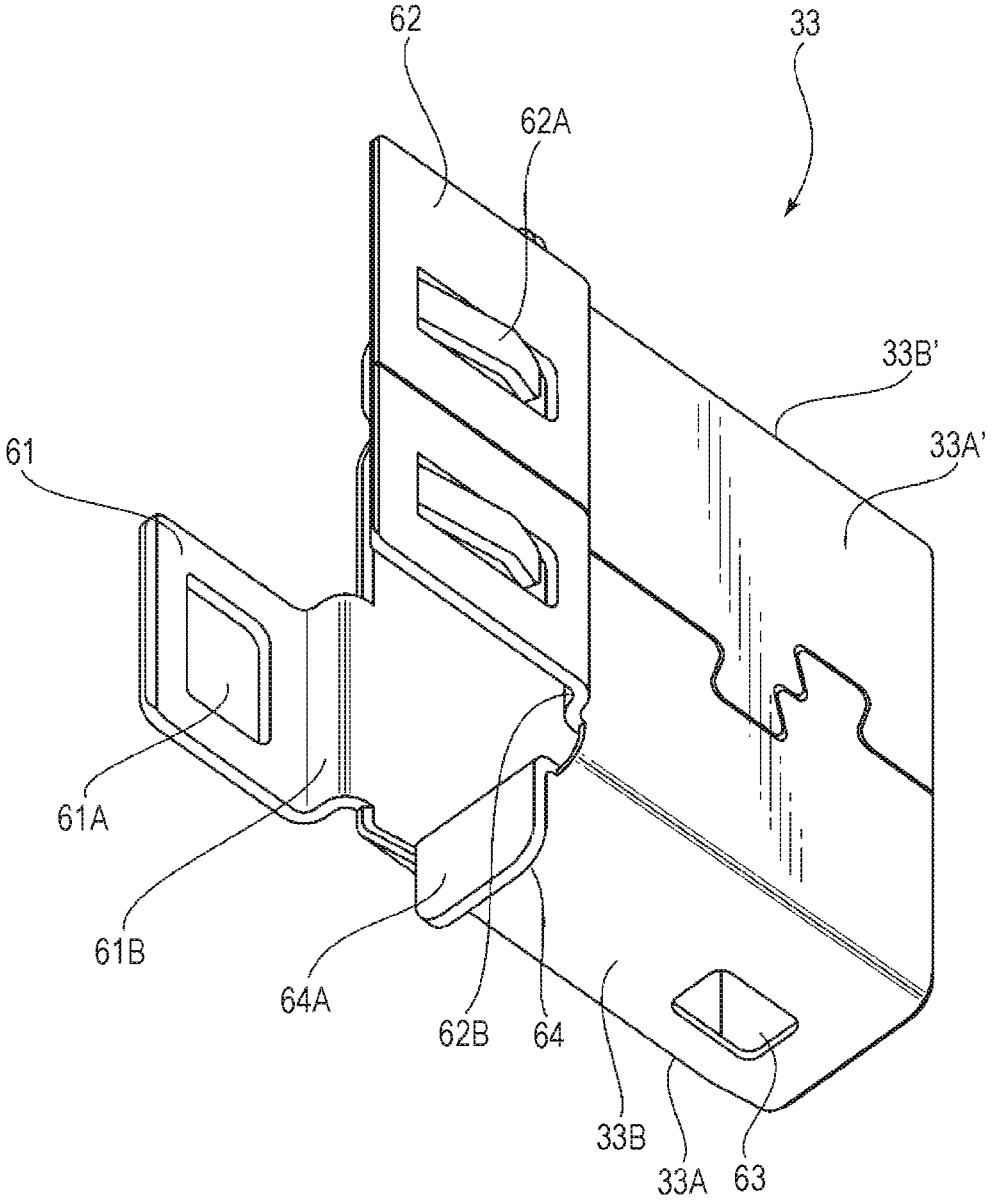
FIG. 9 is a back perspective view of a tubular shell.

FIG. 9 illustrates a back perspective view of the tubular shell 33. As in the body shell 31 and the plate-shaped shell 32, the tubular shell 33 is formed in such a manner that a single metal plate is punched and bent. For example, the tubular shell 33 includes opposing right and left longitudinal plate portions 33A, 33A' and opposing upper and lower lateral plate portions 33B, 33B'. The tubular shell 33 is, as a whole, formed as a substantially rectangular tubular body. Needless to say, the tubular shell 33 is not necessarily formed in a tubular shape, but in the case of the tubular shape, the entirety of the side portion outer peripheral surfaces of the fitting target portion 27 of the housing 20 can be easily covered. The tubular shell 33 can be attached such that the fitting target portion 27 of the housing 20 is inserted into the tube.

At the longitudinal plate portion 33A, a hole 61A is provided at an attachment piece 61 extending toward the body shell 31 to fix the tubular shell 33 to the body shell 31. Upon fixing to the body shell 31, a retaining protrusion 22 protruding from an outer surface of the housing 20 is fitted in the hole 61A. On the other hand, at the longitudinal plate portion 33A', retaining portions 62A are provided at attachment pieces 62 extending toward the body shell 31. Although not apparent from the figure, the retaining portions 62A are retained at predetermined portions of the body shell 31 upon fixing to the body shell 31.

At the longitudinal plate portion 33A, a surface 61B extending to the side of attachment to the fitting target portion 27 is provided in such a manner that the position where the attachment piece 61 is to be provided is slightly shifted outward in the radial direction (e.g., "β"). At the longitudinal plate portion 33A', a surface 62B extending to the side of attachment to the fitting target portion 27 is provided in such a manner that the positions where the attachment pieces 62 is to be provided are slightly shifted outward in the radial direction (e.g., "β"). Further, at the lateral plate portion 33B, a surface 64A extending to the side of attachment to the fitting target portion 27 is provided in such a manner that a standing piece 64 extending outward along the radial direction (e.g., "β") is provided, for example. Note that the standing piece 64 is not necessarily provided along the radial direction, and in accordance with the stepped surface 25 or independently of the stepped surface 25, may be inclined from the small diameter side to the large diameter side as the standing piece 64 extends from the side of fitting to the substrate connector 70 to the opposite side of the fitting side, for example. When the tubular shell 33 is attached to the fitting target portion 27, these surfaces 61B, 62B, 64A can contact the stepped surface 25 of the housing 20, an edge 41C1 of the body shell 31, or both. For example, the surface 64A of the standing piece 64 can contact the stepped surface 25 of the housing 20 or the lateral plate portion 41C of the body shell 31. With these contact portions, the position of the tubular shell 33 can be stably determined at a predetermined position of the housing 20 or the body shell 31.

When the tubular shell 33 is attached to the fitting target portion 27, the lock protrusion 55 provided at the free end of the elastic arm 50 is, by the elasticity thereof, brought into a state in which the lock protrusion 55 protrudes from an ejecting hole 63 provided at the lateral plate portion 33B of the tubular shell 33. Moreover, in this state, at least part of the free end side of the elastic arm 50, specifically a free end side of the narrow portion 53 of the elastic arm 50, is arranged between the tubular shell 33 and the housing 20. As a result, at least part of the free end side of the elastic arm 50 is protected by the tubular shell. Thus, buckling of the elastic arm 50 can be suppressed, and the cable connector 10 and the substrate connector 70 can be more smoothly fitted to each other. Note that recesses 29 for housing the elastic arms 50 are preferably provided at the fitting target portion 27 of the housing 20. With the recesses 29 where the elastic arms 50 are housed, a clearance between the tubular shell 33 and the housing 20 can be more reduced.

Figure 10:
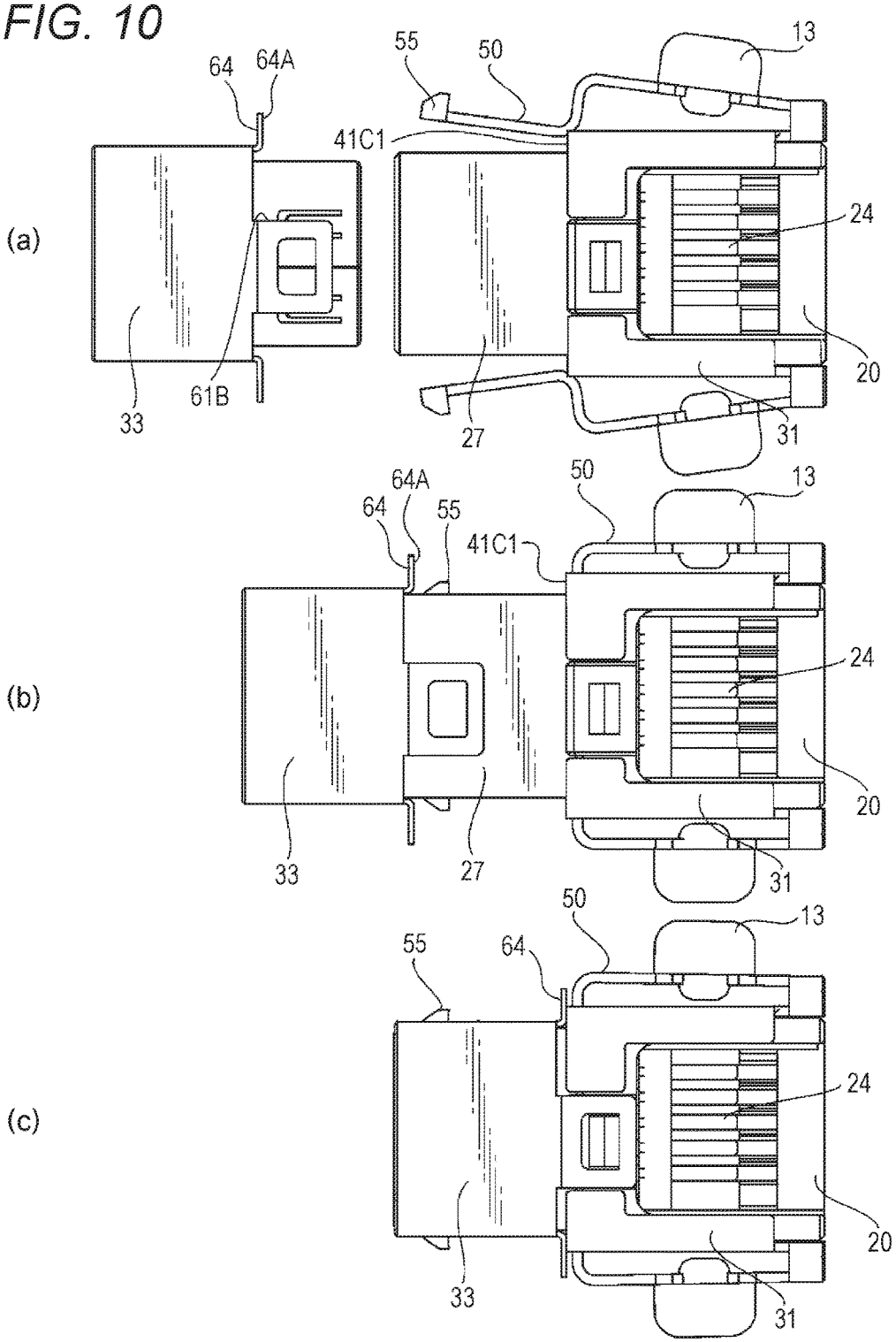
FIG. 10 is a view for describing the method for assembling the tubular shell to a housing.

The method for assembling the tubular shell 33 with the fitting target portion 27 of the housing 20 will be described with reference to FIG. 10. FIG. 10 illustrates side views of the housing 20, the body shell 31 attached to the housing 20, and the tubular shell 33 assembled with the housing 20 and the body shell 31. Note that the plate-shaped shell 32 is omitted.

As will be clearly seen from of FIG. 10, at least part of the free end side of each elastic arm 50 is, for enhancing the elastic force of the elastic arm, constantly biased outward, i.e., biased from the center side of the housing 20 to the side of attachment to the tubular shell 33. Thus, for arranging each elastic arm 50 between the tubular shell 33 and the housing 20, the free end side of the elastic arm 50 specifically needs to be displaced to the center side of the housing 20 by the button 13 and the like. and be brought into a state illustrated in (a) of FIG. 10 to a state illustrated in (b) of FIG. 10. After such a state has been brought, the tubular shell 33 slides toward the fitting target portion 27. In this state, e.g., each standing piece 64 provided at the tubular shell 33 and extending in the radial direction can be utilized as a guide portion of the elastic arm 50, specifically the lock protrusion 55 provided at a tip end of the elastic arm 50. When the tubular shell 33 reaches a position illustrated in (c) of FIG. 10 relative to the housing 20, the lock protrusion 55 of each elastic arm 50 elastically protrudes from the ejecting hole 63 of the tubular shell 33. Further, in this state, the surface 619 provided at the longitudinal plate portion 33A, the surface 62B (see FIG. 3 and the like.) provided at the longitudinal plate portion 33A', and the surface 64A provided at the lateral plate portion 339 can respectively contact the stepped surface 25 (see FIG. 3 and the like.) of the housing 20 or the edge 41C1 of the body shell 31.

Figure 11:
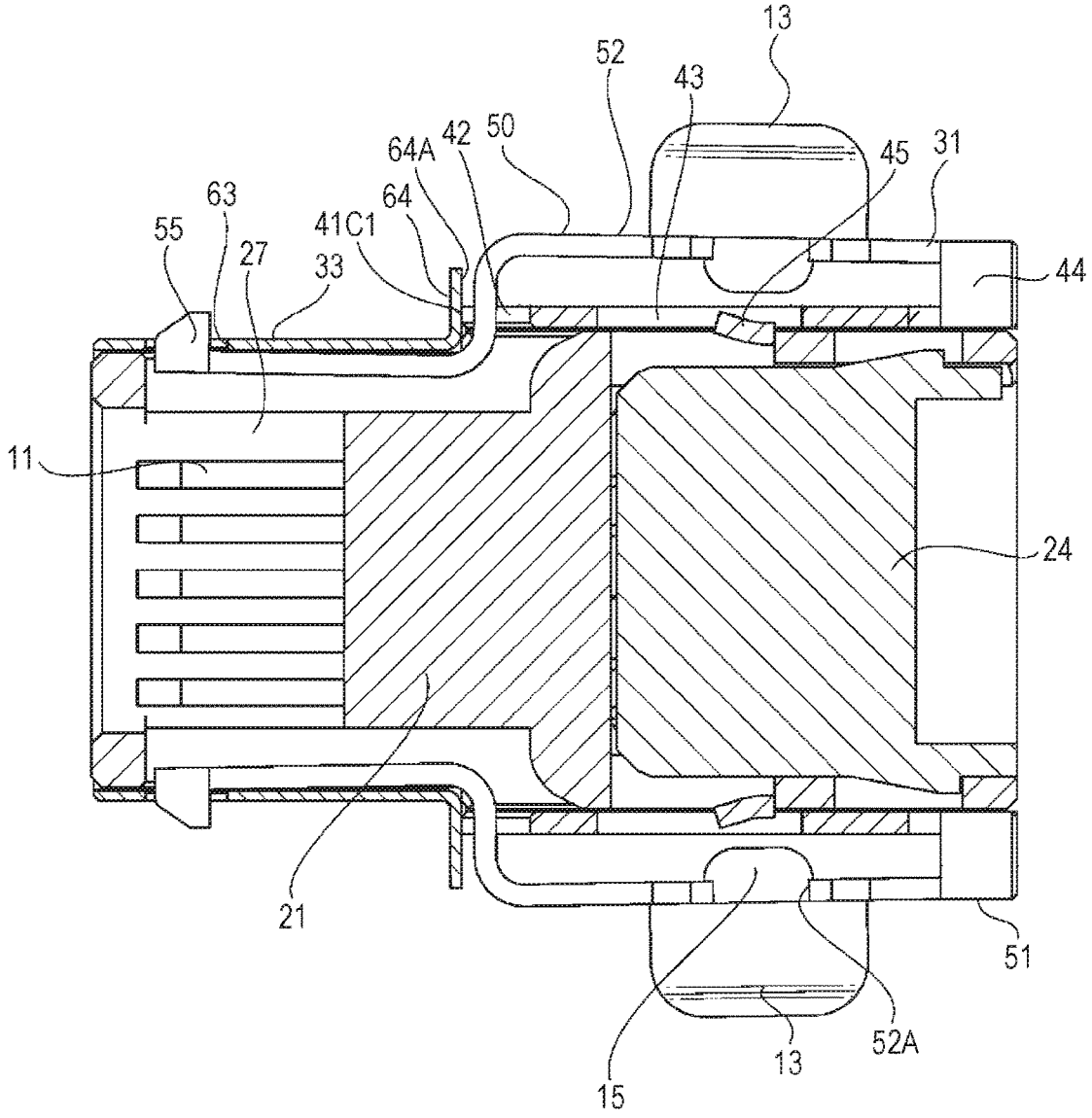
FIG. 11 is a schematic sectional view of the cable connector along a center line.
Figure 12:
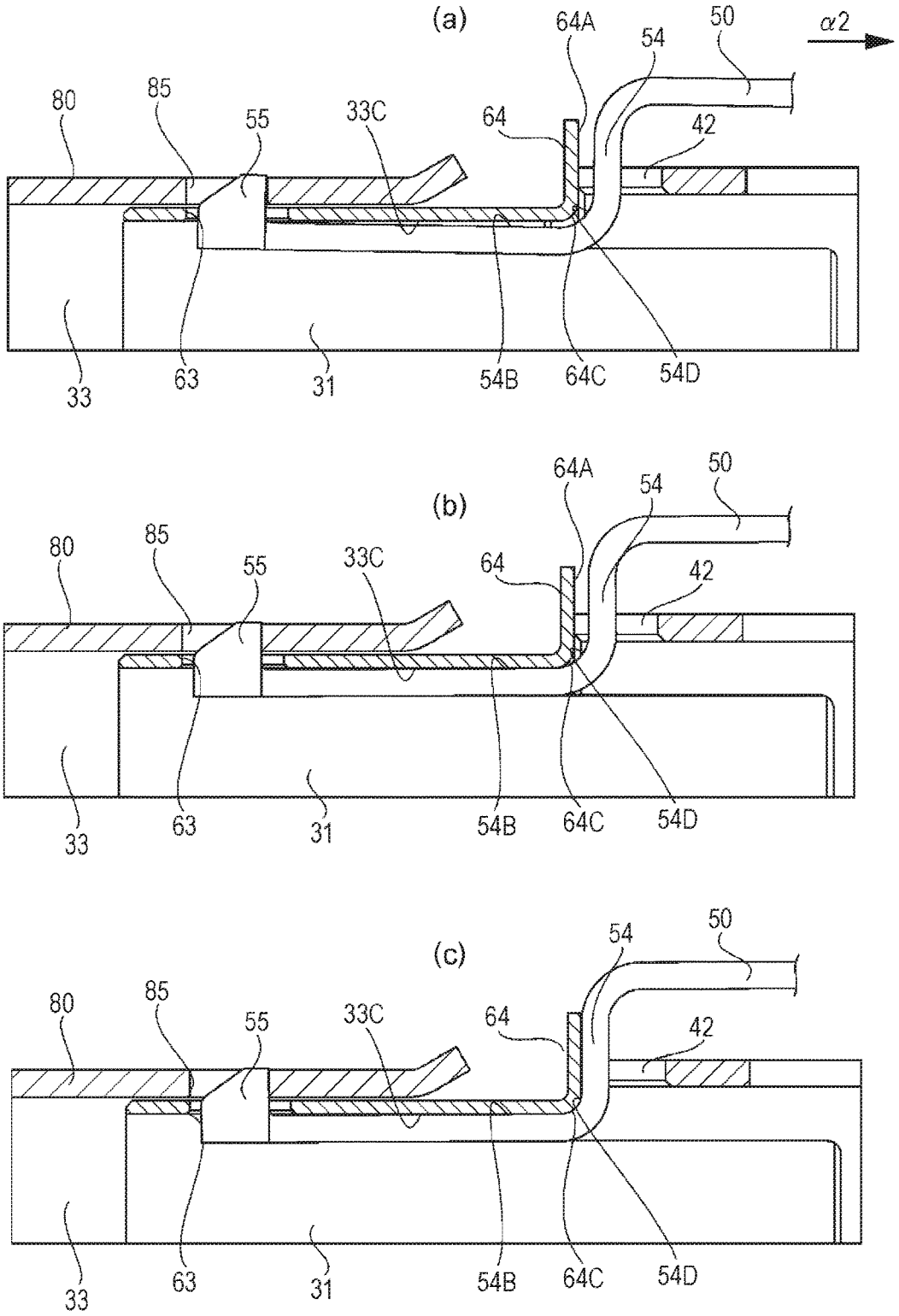
FIG. 12 is a schematic view of a deformation state of an elastic arm in a stepwise manner.
Figure 13:
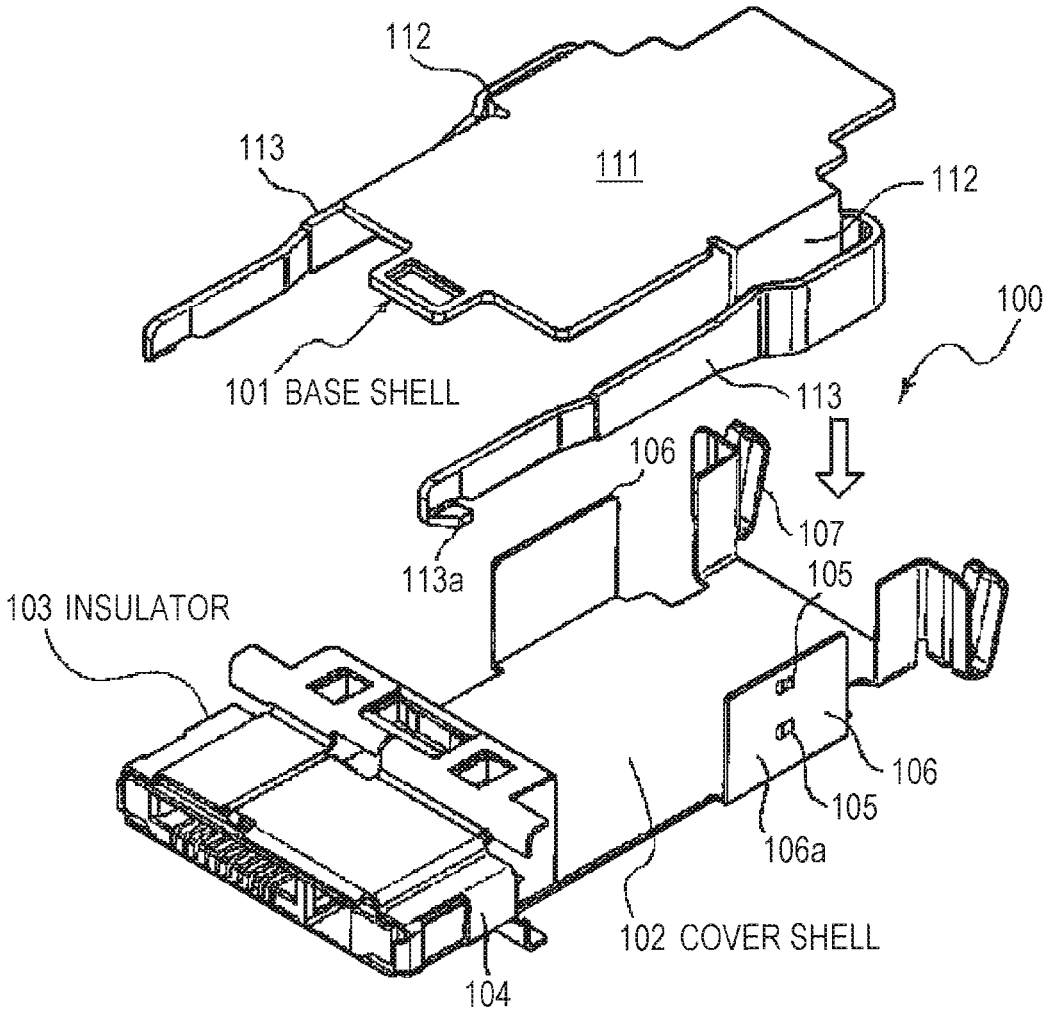
FIG. 13 is a view of a typical example.

The structure for suppressing pulling by the standing pieces 64 provided at the tubular shell 33 will be described with reference to FIGS. 11 and 12. FIG. 11 is a schematic sectional view of the cable connector 10 along a center line. FIG. 12 is an enlarged view of the periphery of the standing piece 64 at the cable connector 10 of FIG. 11 in the state of fitting to the substrate connector 70, FIG. 12 being a schematic view for illustrating, in a stepwise and concise manner, the way to deform the elastic arm 50 when the cable connector 10 is forcibly detached from the substrate connector 70 after the cable connector 10 and the substrate connector 70 have been fitted to each other. Each standing piece 64 described herein substantially extends, at a position closer to the side of fitting to the substrate connector 70 than the stepped portion 54 of the elastic arm 50, in the radial direction (e.g., "β") to face the stepped portion 54. Note that the standing piece 64 is not necessarily provided along the radial direction, and in accordance with the elastic arm 50 or independently of the elastic arm 50, may be inclined from the small diameter side to the large diameter side as the standing piece 64 extends from the side of fitting to the substrate connector 70 to the opposite side of the fitting side, for example. Further, the standing piece 64 is good enough to face the stepped portion 54, and it is not required that the standing piece 64 is precisely "along" the stepped portion 54. Note that for obtaining the effect of the standing piece 64, the standing piece 64 is preferably "substantially along" the stepped portion 54.

As described with reference to FIG. 9, at least part of the free end side of the elastic arm 50 is, for enhancing the elastic force of the elastic arm, constantly biased from the center side of the housing 20 toward an attachment side of the tubular shell 33. However, at at least part of the free end side of the elastic arm 50 arranged between the tubular shell 33 and the housing 20, the side provided with the lock protrusion 55 is at a position slightly closer to the attachment side of the tubular shell 33 than the side provided with the stepped portion 54. Thus, as illustrated in (a) of FIG. 12, a clearance 59 larger than that on the side provided with the lock protrusion 55 is formed between an outer surface 54B of the elastic arm 50 and an inner surface 33C of the lateral plate portion 33B of the tubular shell 33 on the side provided with the stepped portion 54 of the elastic arm 50. Upon pulling in the direction of detaching the cable connector 10 from the substrate connector 70, i.e., the direction of "α2," the elastic arm 50 deforms to approach the side of the tubular shell 33 and fill the clearance 59, and as illustrated in (b) of FIG. 11, the outer surface 54B of the elastic arm 50 and the inner surface 33C of the lateral plate portion 33B of the tubular shell 33 are brought into a contact state. With this configuration, drag against the force of detaching the cable connector 10 from the substrate connector 70 is generated. Thereafter, upon further pulling in the direction of "α2," the vicinity of the stepped portion 54 of the elastic arm 50 specifically deforms. As a result, an outer surface 54D of the vicinity of a curved portion of the stepped portion 54 comes into collision with the standing piece 64, specifically an inner surface 64C of the vicinity of a curved portion of the standing piece 64, and therefore, the force of further suppressing pulling acts. As described above, the standing pieces 64 are provided, so that strength against casual pulling can be enhanced by collision between part of the elastic arm 50 and at least part of the standing pieces. Note that the clearance 59 is not necessarily required, and substantially no clearance 59 may be formed.

Note that the present invention is not limited to the above-described embodiment, and various other changes can be made. Thus, the embodiment disclosed herein has been set forth as an example, and is not limitative. The scope of the present invention shall be determined not by description above but by the scope of the claims, and all changes within a meaning and a scope equivalent to the scope of the claims are included.

DESCRIPTION OF REFERENCE SIGNS

1 Connector device
3 Substrate
10 Cable connector (connector)
20 Housing
23C Side portion outer peripheral surface
23D Side portion outer peripheral surface
25 Stepped surface
21 Body portion
27 Fitting target portion
30 Conductive shell
31 Body shell (first shell)
32 Plate-shaped shell (third shell)
33 Tubular shell (second shell)
33C Inner surface
44 Support portion
50 Elastic arm
54 Stepped portion
54B Outer surface
54D Outer surface
55 Lock protrusion
59 Clearance
64 Standing piece
64C Inner surface
70 Substrate connector (partner connector)
71 Contact
72 Housing
80 Conductive shell

The invention claimed is:

1. A connector fittable to a partner connector, comprising:
a housing;
a contact attached to the housing; and
a conductive shell attached to the housing,
wherein the housing includes a body portion and a fitting target portion extending from the body portion to a side of fitting to the partner connector,
a diameter of a side portion outer peripheral surface of the fitting target portion is, at at least part thereof, set smaller than a diameter of a side portion outer peripheral surface of the body portion,
the conductive shell includes a first shell and a second shell,
the first shell includes a cover portion configured to cover at least part of an outer peripheral surface of the housing, an elastic arm having a free end on the side of fitting to the partner connector, and a support portion elastically connecting the elastic arm to the cover portion and configured to support the elastic arm in a cantilever manner,
the elastic arm has a lock portion configured to lock fitting between the connector and the partner connector at a position closer to a free end side than the support portion,
the elastic arm has a stepped portion corresponding to a stepped surface of the housing provided using a difference in the diameter between the body portion and the fitting target portion,
the second shell includes a portion facing the stepped portion at a position closer to the side of fitting to the partner connector than the stepped portion of the elastic arm,
the elastic arm and the cover portion are made out of a single metal plate and continuous to each other,
the elastic arm is held apart from the cover portion through the support portion and positioned outer than the cover portion in a radial direction,
the cover portion and the elastic arm have substantially opposing surfaces, the surface of the elastic arm being positioned outer than the surface of the cover portion in the radial direction,
the second shell further includes an ejection hole, and
the lock portion is positioned inside of the ejection hole and a part of the lock portion protrudes from the ejection hole.

2. The connector according to claim 1, wherein
at least part of the free end side of the elastic arm is provided at a position closer to the fitting target portion than the support portion in the radial direction.

3. The connector according to claim 2, wherein
at least part of the free end side of the elastic arm having the lock portion is arranged between the second shell and the housing.

4. The connector according to claim 3, wherein a recess configured to house at least part of the free end side of the elastic arm is provided at the fitting target portion of the housing.

5. The connector according to claim 3, wherein the at least part of the free end side of the elastic arm arranged between the second shell and the housing is constantly biased from a housing side toward a second shell side.

6. The connector according to claim 1, wherein the second shell has a surface extending in the radial direction, and at the surface, is able to contact the stepped surface of the housing and/or the first shell.

7. The connector according to claim 1, wherein the conductive shell further includes a third shell configured to cover at least part of the outer peripheral surface of the body portion not covered with the first shell.

8. The connector according to claim 1, wherein the first shell is formed from the single metal plate.

9. A connector device comprising:

the connector according to claim 1 and the partner connector.

* * * * *